US007674059B2

(12) United States Patent
Daigle

(10) Patent No.: US 7,674,059 B2
(45) Date of Patent: Mar. 9, 2010

(54) COMBINED JOINT COMPOUND DISPENSER AND APPLICATOR FOR CORNERS

(76) Inventor: Marcel Daigle, 5501, Louis-Badaillac, Carignan, Quebec (CA) J3L 4A7

( * ) Notice: Subject to any disclaimer, the term of this patent is extended or adjusted under 35 U.S.C. 154(b) by 500 days.

(21) Appl. No.: 11/707,458

(22) Filed: Feb. 14, 2007

(65) Prior Publication Data

US 2007/0206985 A1 Sep. 6, 2007

Related U.S. Application Data

(60) Provisional application No. 60/777,205, filed on Feb. 28, 2006.

(51) Int. Cl.
*A46B 11/00* (2006.01)
*B05C 11/00* (2006.01)

(52) U.S. Cl. ..... 401/48; 401/9; 401/265; 401/266; 425/87

(58) Field of Classification Search ..... 401/48, 401/9, 261, 263, 265, 266; 156/579; 425/87, 425/458

See application file for complete search history.

(56) References Cited

U.S. PATENT DOCUMENTS 2,594,606 A 4/1952 Ames
2,824,443 A 2/1958 Ames
3,932,101 A 1/1976 Johnson et al.
4,451,223 A 5/1984 Mower et al.
4,767,297 A 8/1988 Power et al.
5,010,618 A 4/1991 Croft
5,263,836 A 11/1993 Tinawong
5,419,693 A 5/1995 MacMillan
5,423,666 A 6/1995 MacMillan
5,622,729 A 4/1997 Mower
5,695,788 A 12/1997 Woods
6,155,809 A 12/2000 Edwards et al.
6,419,773 B1 7/2002 Lauermann
6,733,262 B1 * 5/2004 Denkins ..... 425/87

* cited by examiner

*Primary Examiner*—David J Walczak

(57) ABSTRACT

A combined joint compound dispenser and applicator for corners comprises a cylinder mechanically attached to a tube extending therefrom. The cylinder pushes a compound by way of a piston. A ball joint provides an articulated connection between the tube and an applicator by way of an insertion shoe. The applicator has two flaps cojoined at an apex so as to form a <<V>> shape. The compound passes from the tube through the applicator by way of a slit, and that slit is formed by an arrow shaped element placed in front of a hole. The hole is at the apex. Wheels located on wedges allow the applicator to roll on walls. The wedges extend integrally from the flaps.

3 Claims, 3 Drawing Sheets

COMBINED JOINT COMPOUND DISPENSER AND APPLICATOR FOR CORNERS

This application claims priority based on provisional application 60/777,205 filed Feb. 28, 2006

FIELD OF THE INVENTION

The invention relates generally to hand tools but more specifically to a tool used for dispensing joint filling compound used in gyproc sheeting installation.

BACKGROUND OF THE INVENTION

Filling joints with compound, especially in room corners is a difficult operation and over the years, a number of products have been developed to address this issue.

There are two categories of tools: The simple tools which have been used for years and were probably never patented and there are more complex tools which are themselves subdivided into two categories: Those that provide for a clean, even spreading of the joint filling compound and those that do that but with the added convenience of pushing the joint filling compound which is contained in a container that forms an internal part of the device.

Such combined devices have the drawback of either being very good at dispensing joint filler and not very good at applying it or very good at applying but not reliable in providing a steady supply of joint filling compound.

For example, U.S. Pat. No. 3,932,101 has a wheel that tend to clog up with compound and becomes quite inefficient over time. Other systems such as U.S. Pat. Nos. 2,59,4606 and 2,824,443 and 3,932,101 have openings which do not provide for even distribution of compound material. Generally, because of the shape of the devices gliding motion along a wall is not smooth and regular.

SUMMARY OF THE INVENTION

In view of the foregoing disadvantages inherent in the known devices now present in the prior art, the present invention, which will be described subsequently in greater detail, is to provide objects and advantages which are:

To provide for a device which applies joint filling compound in corners in a clean and even manner.

To provide for a device which provides a smooth, even gliding motion along a wall to provide even spread of the compound.

To attain these ends, the present invention generally comprises a cylinder mechanically attached to a tube extending therefrom. The cylinder pushes a compound by way of a piston. A ball joint provides an articulated connection between the tube and an applicator by way of an insertion shoe. The applicator has two flaps co-joined at an apex so as to form a <<V>> shape. The compound passes from the tube through the applicator by way of a slit, and that slit is formed by an arrow shaped element placed in front of a hole. The hole is at the apex.

Wheels located on wedges allow the applicator to roll on walls. The wedges extend integrally from the flaps.

The combined joint compound dispenser and applicator for corners preferably is equipped with a carbide tip situated at the apex so as to create a line at the wall corner.

In a preferred embodiment, the combined joint compound dispenser and applicator for corners has a biasing means that exerts pressure on the flaps so as to maintain the <<V>> shape at an angle which makes the compound feather down towards the winglets.

The combined joint compound dispenser and applicator for corners has the following method of use:

A user runs the combined joint compound dispenser and applicator for corners downwardly at a wall corner while pushing on the piston so as to expel the compound from the cylinder.

The wheels provide downward motion and the compound exits by way of the slit and the compound spreads and extends between the walls and the flaps whereby the flaps smooth out the compound until the compound reaches the winglets so as to be feathered out.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter which contains illustrated preferred embodiments of the invention.

DETAILED DESCRIPTION

Figure 1:
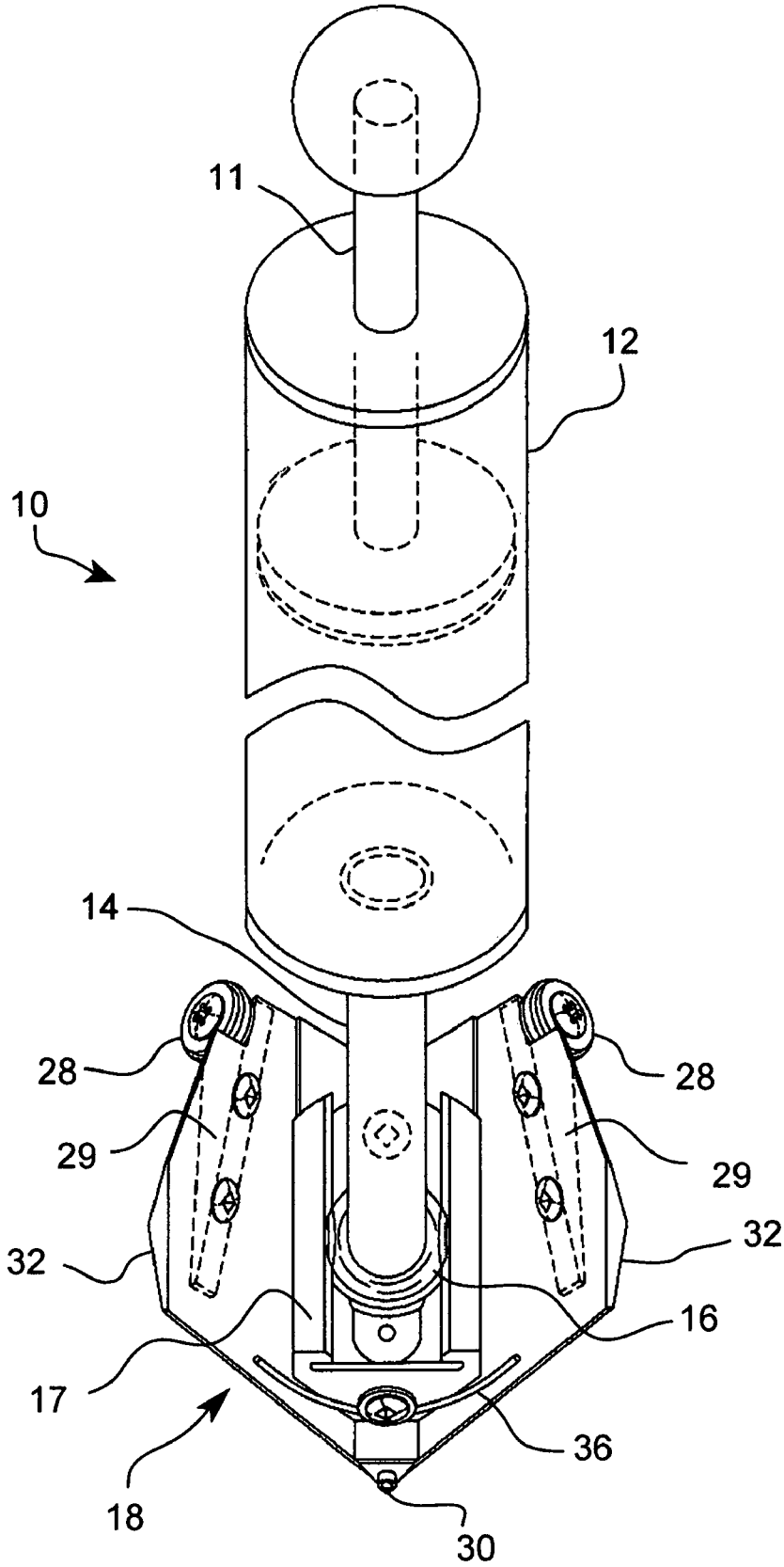
FIG. 1 Isometric view of the joint compound dispenser applicator.
Figure 2:
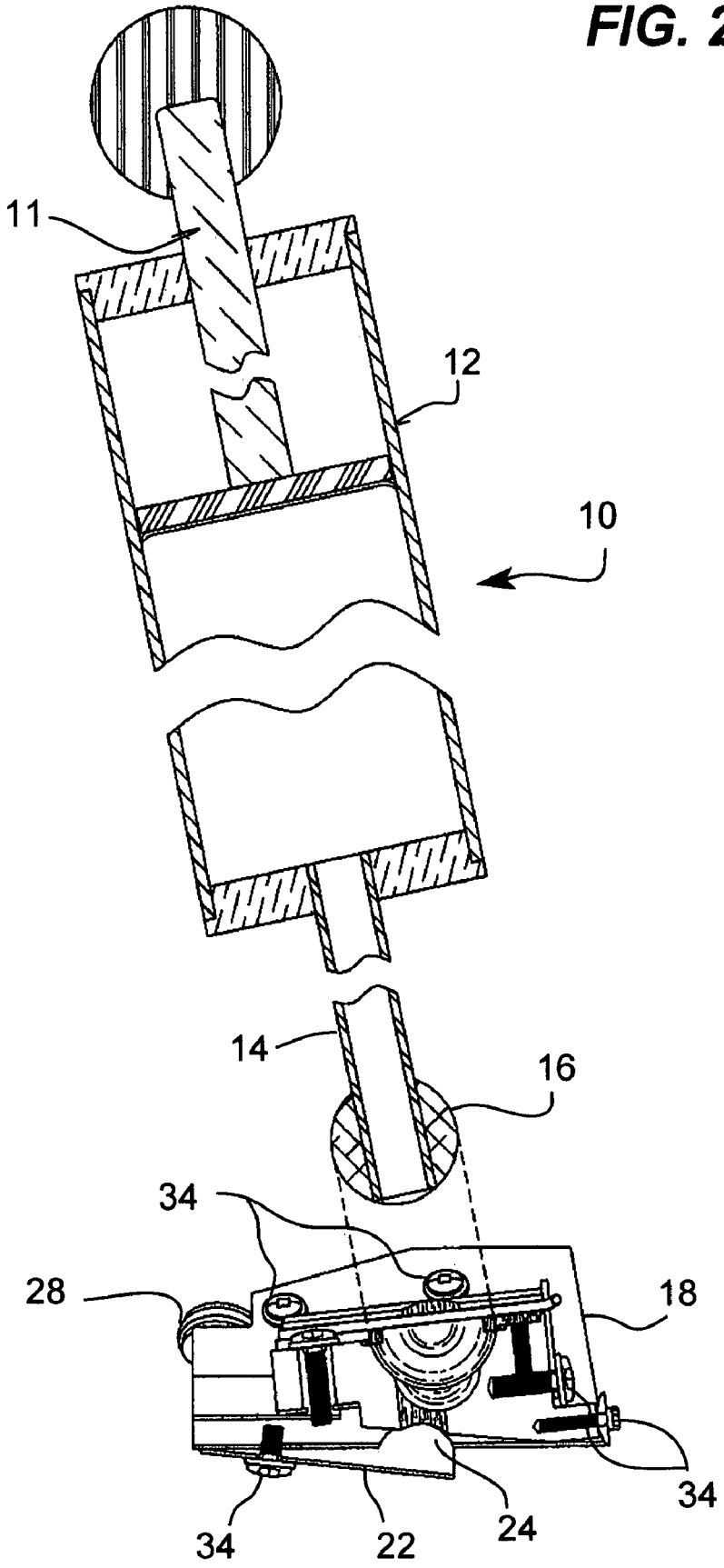
FIG. 2 Side cutaway view of the joint compound dispenser applicator.
Figure 3:
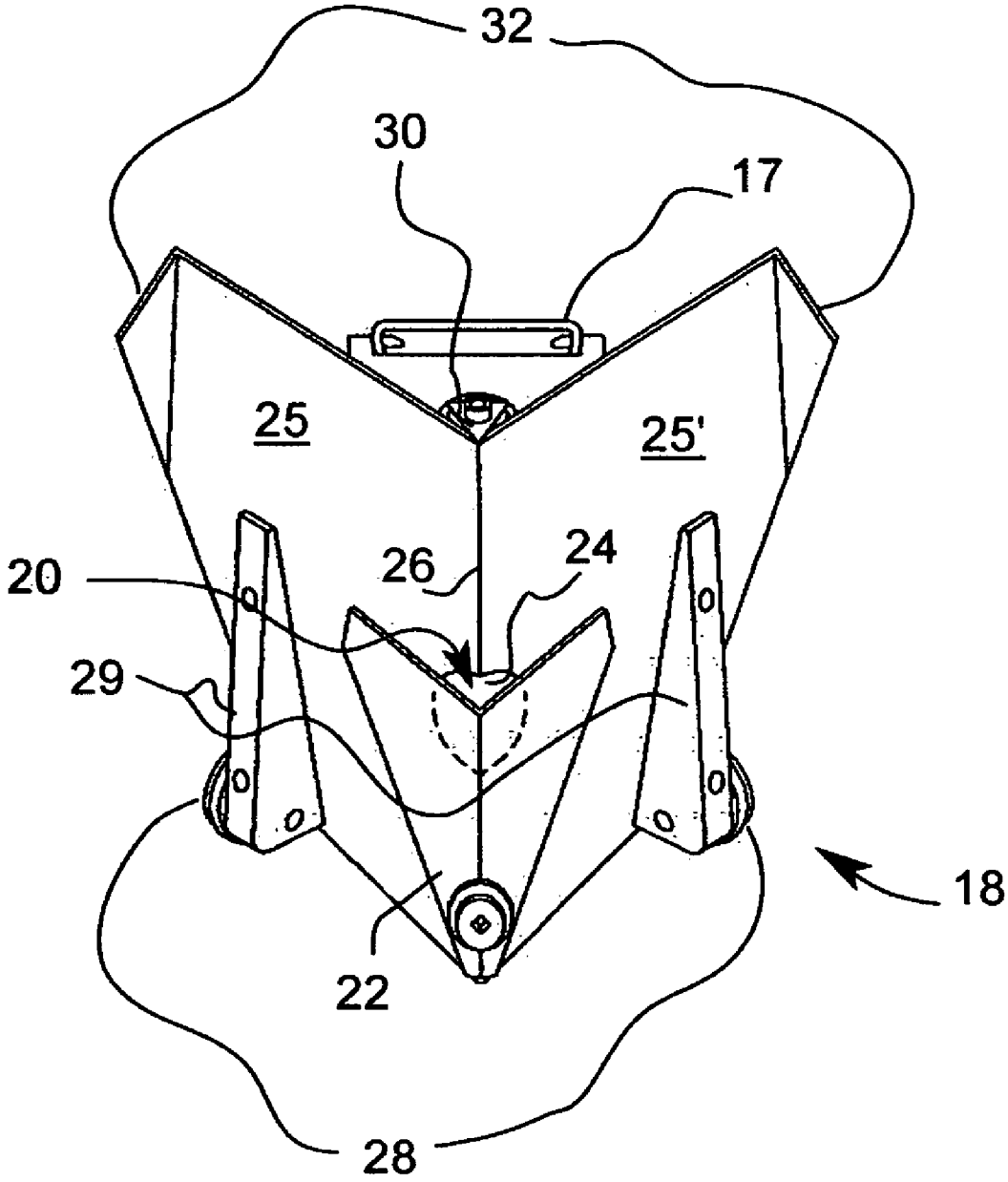
FIG. 3 Front view of the joint compound dispenser applicator.

A combined joint compound dispenser and applicator for corners (10) has a dispenser cylinder (12) mechanically attached to a tube (14) extending therefrom. The dispenser cylinder (12) pushes compound by way of a piston (11). The piston (11) can be manually pushed as per FIG. 1 or it can be cranked by a cranking handle as is known for caulking tubes. Generally, such dispensing devices are known in the art and need not be further discussed herein except for the details of the mechanical connection between the dispenser cylinder (12) and an applicator (18) which is by way of a ball joint (16) providing an articulated connection of the tube (14) to the applicator (18) by way of an insertion shoe (17).

The applicator (18) has two flaps (25, 25') co-joined at an apex (26) so as to form a <<V>> shape which conforms to a 90 degree angle corner wall without itself being 90 degrees as will be explained later. This <<V>> shape configuration is also well known in the art given that most wall corners are right angle corners. Fluid compound is passed from the tube (14) through the applicator part (18) by a slit (20) created by an arrow shaped element (22) placed in front of a hole (24) situated across an apex (26) of the applicator part (18). This configuration does not allow for the compound to escape too quickly from the cylinder (12) and starts the feathering of the compound even before it makes contact with the walls (not shown). Extending integrally from the flaps (25, 25') are winglets (32). The arrow shaped element (22) is also <<V>> shaped but with a slightly different angle which creates the slit (20). The compound extends and is smoothed out by the flaps (25, 25') until it reaches the winglets (32) by which time it has pretty much feathered out. Wedges (29) which extend integrally from the flaps (25, 25') and winglets (32) maintain the flaps (25, 25') at the appropriate angle. To further provide for a smooth and easy application, wheels (28) located on the wedges (29) has the applicator part (18) roll on the walls. A carbide tip (30) situated at the apex (26) provides a clean line at the corner's edge. A biasing means (36) exerts pressure on the flaps (25, 25') so that the <<V>> shape is not bent but rather maintains an angle which makes the layer of compound feather down towards the winglets (32). Although mechanical fastening means (34) are shown as screws, they can advantageously be replaced by bolts, rivets, welding, gluing or by having parts molded or machined integrally in order to replace most or all mechanical fastening means (34).

In order to use the combined joint compound dispenser and applicator for corners (10), a user runs it downwardly at a wall corner while pushing on the piston (11) so as to expel the compound from the cylinder (12).

The wheels (28) provide downward motion and the compound exits by way of the slit (20) and the compound spreads and extends between the walls and the flaps (25, 25') whereby they smooth out the compound until it reaches the winglets (32) so as to be feathered out.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A combined joint compound dispenser and applicator for corners comprising:

a cylinder mechanically attached to a tube extending therefrom;

said cylinder adapted for pushing compound by way of a piston;

a ball joint provides an articulated connection between said tube and an applicator by way of an insertion shoe;

said applicator has two flaps co-joined at an apex so as to form a <<V>> shape;

a slit adapted for passing compound from said tube through said applicator;

said slit being formed by an arrow shaped element placed in front of a hole;

said hole located at said apex;

wheels located on wedges allow said applicator to roll on walls;

said wedges extending integrally from said flaps.

2. A combined joint compound dispenser and applicator for corners as in claim 1 wherein:

a carbide tip situated at said apex creates a line at the wall corner.

3. A combined joint compound dispenser and applicator for corners as in claim 1 wherein:

a biasing means exerts pressure on said flaps so as to maintain the <<V>> shape at an angle adapted to make compound feather down towards said winglets.

* * * * *